US011221178B2

(12) United States Patent
Haik-Beraud et al.

(10) Patent No.: US 11,221,178 B2
(45) Date of Patent: Jan. 11, 2022

(54) HEAT EXCHANGER WITH LIQUID/GAS MIXER DEVICE HAVING OPENINGS WITH AN IMPROVED SHAPE

(71) Applicant: L'Air Liquide, Société Anonyme pour l'Etude et l'Exploitation des Precédés Georges Claude, Paris (FR)

(72) Inventors: Natacha Haik-Beraud, Champigney-sur-Marne (FR); Philippe Grigoletto, Villeparisis (FR); Sophie Lazarrini, Saint Mande (FR); Jean-Marc Peyron, Creteil (FR); Jorge Ernesto Tovar Ramos, Cachan (FR)

(73) Assignee: L'Air Liquide, Société Anonyme pour l'Etude et l'Exploitation des Precédés Georges Claude, Paris (FR)

( * ) Notice: Subject to any disclaimer, the term of this patent is extended or adjusted under 35 U.S.C. 154(b) by 156 days.

(21) Appl. No.: 16/496,789

(22) PCT Filed: Mar. 20, 2018

(86) PCT No.: PCT/FR2018/050666
§ 371 (c)(1),
(2) Date: Sep. 23, 2019

(87) PCT Pub. No.: WO2018/172685
PCT Pub. Date: Sep. 27, 2018

(65) Prior Publication Data

US 2021/0108855 A1 Apr. 15, 2021

(51) Int. Cl.

| | |
|---|---|
| ***F25J 5/00*** | (2006.01) |
| ***F28F 9/02*** | (2006.01) |
| ***F28D 9/00*** | (2006.01) |

(52) U.S. Cl.
CPC ..... *F25J 5/002* (2013.01); *F28D 9/0068* (2013.01); *F25J 2290/32* (2013.01); *F28F 9/028* (2013.01); *F28F 9/0278* (2013.01)

(58) Field of Classification Search
CPC ..... F25J 1/0022; F25J 1/0045; F25J 1/0262; F25J 3/04412; F25J 5/002; F25J 2250/02;
(Continued)

(56) References Cited

U.S. PATENT DOCUMENTS 3,380,517 A * 4/1968 Butt ..... F25J 5/002 165/166
3,559,722 A * 2/1971 Schauls ..... F25J 5/002 165/166

(Continued)

FOREIGN PATENT DOCUMENTS

| | | |
|---|---|---|
| CN | 103983138 | 8/2014 |
| EP | 0 740 119 | 10/1996 |
| FR | 2 563 620 | 4/1985 |

OTHER PUBLICATIONS

International Search Report and Written Opinion for corresponding PCT/FR2018/050666, dated May 7, 2018.

*Primary Examiner* — Eric S Ruppert
*Assistant Examiner* — Hans R Weiland
(74) *Attorney, Agent, or Firm* — Elwood L. Haynes

(57) ABSTRACT

A heat exchanger with several plates arranged in parallel is provided. The heat exchanger has a first series of passages for channeling at least one first fluid and a second series of passages for channeling at least one second fluid. The second fluid being in a heat-exchange relationship with at the first fluid. A mixer is arranged in the passage of the first series. The mixer has at least one first channel for the flow of a first phase of the first fluid in a flow direction. The mixer has at least one second channel for the flow of a second phase of the first fluid. The mixer has at least one opening
(Continued)

fluidically connecting the first channel to the second channel.

3 Claims, 3 Drawing Sheets

(58) Field of Classification Search
CPC ..... F25J 2290/32; F28D 9/0068; F28D 2021/0033; F28F 9/0263; F28F 9/0278; F28F 9/028; F28F 27/02; F28F 2250/108
See application file for complete search history.

(56) References Cited

U.S. PATENT DOCUMENTS

| | | | | |
|---|---|---|---|---|
| 3,880,231 | A * | 4/1975 | Gauthier | F25J 5/002 165/166 |
| 4,450,903 | A * | 5/1984 | Butt | F28D 9/0068 165/110 |
| 4,646,822 | A * | 3/1987 | Voggenreiter | F25J 5/002 165/166 |
| 5,122,174 | A * | 6/1992 | Sunder | F25J 5/005 62/654 |
| 7,163,051 | B2 * | 1/2007 | Jibb | F28F 9/026 165/110 |
| 2005/0045312 | A1 | 3/2005 | Jibb | |
| 2012/0061064 | A1 * | 3/2012 | Stromer | F28F 9/0273 165/177 |
| 2017/0276414 | A1 * | 9/2017 | Higashiiue | F25B 41/37 |

* cited by examiner

HEAT EXCHANGER WITH LIQUID/GAS MIXER DEVICE HAVING OPENINGS WITH AN IMPROVED SHAPE

CROSS REFERENCE TO RELATED APPLICATIONS

This application is a 371 of International PCT Application PCT/FR2018/050666, filed Mar. 20, 2018, which claims priority to French Patent Application 1752474, filed Mar. 24, 2017, the entire contents of which are incorporated herein by reference.

BACKGROUND

The present invention relates to a heat exchanger comprising series of passages for each of the fluids to be placed in a heat-exchange relationship, the exchanger comprising at least one mixing device configured to distribute at least one mixture having two liquid/gas phases into one of the series of passages.

In particular, the present invention may apply to a heat exchanger which vaporizes at least one flow of liquid—gas mixture, particularly a flow of multi-constituent mixture, for example a mixture of hydrocarbons, through exchange of heat with at least one other fluid, for example natural gas.

The technology commonly employed for an exchanger is that of aluminum brazed plate and fin exchangers, which make it possible to obtain devices that are highly compact and offer a large exchange surface area.

These exchangers comprise plates between which are inserted heat-exchange corrugations, formed of a succession of fins or corrugation legs, thus constituting a stack of vaporization passages and of condensation passages, one intended to vaporize refrigerant liquid and the other intended to condense a calorigenic gas. The exchanges of heat between the fluids may take place with or without phase change.

In order to ensure correct operation of an exchanger employing a liquid—gas mixture, the proportion of liquid phase and of gas phase needs to be the same in all of the passages and needs to be uniform within one same passage.

The dimensions of the exchanger are calculated on the assumption of a uniform distribution of the phases, and therefore of a single temperature at the end of vaporization of the liquid phase, equal to the dew point of the mixture.

In the case of a multi-constituent mixture, the temperature at the end of vaporization is going to depend on the proportion of liquid phase and of gas phase in the passages.

In the event of an unequal distribution of the two phases, the temperature profile of the first fluid is then going to vary from passage to passage, or even vary within the one same passage. Because of this non-uniform distribution, there is the possibility that the fluid(s) in a heat-exchange relationship with the two-phase mixture may have an exchanger outlet temperature that is higher than intended, and this consequently degrades the performance of the heat exchanger.

One solution for distributing the liquid and gas phases of the mixture as uniformly as possible is to introduce them into the exchanger separately, then mix them together once they are inside the exchanger.

Document FR-A-2563620 describes such an exchanger in which a grooved bar is inserted into the series of passages which is intended to channel the two-phase mixture. This mixer device comprises separate channels for a liquid phase and for a gas phase, and an outlet for distributing the liquid-gas mixture to the heat-exchange zone.

A problem which arises with this type of mixer device concerns the distribution of the liquid-gas mixture in the width of the passage containing the mixer device. In order to mix the two phases, the mixer device generally comprises a first channel for the flow of one phase. This channel is equipped with a series of openings arranged along the channel, each opening being fluidically connected to the second channel for the flow of the other phase. When the inlet to the first channel is supplied with fluid, the flow rate of the fluid will tend to diminish as the fluid flows along the channel. This is because the flow of fluid reduces as the openings are supplied.

The openings are generally machined perpendicularly to the longitudinal direction of the fluid, and are therefore less well supplied when the fluid speed is higher. The openings arranged on the channel inlet side therefore have a tendency to be over-supplied, whereas the openings situated on the base of the channel are under-supplied. The result is an uneven introduction of the respective phase into the channel for the other phase, and hence an unequal distribution of the liquid-gas mixture in the width of the exchanger passage.

In order to minimise this phenomenon, one solution is to supply the channel concerned via two opposite inlets of the channel. However, this results in a complication of the heat exchanger, and the problem of uneven distribution remains at least in the central part of the channel.

Increasing the number of channels is also not an ideal solution in view of the mechanical strength and brazing of the device.

Another known solution is to arrange openings of cylindrical form with different diameters along the channel. However, this solution may prove insufficient for certain processes.

SUMMARY

It is an object of the present invention to fully or partially solve the above-mentioned problems, notably by proposing a heat exchanger in which the distribution of the liquid and gas phases of a mixture is as uniform as possible, and to do so without excessively adding to the complexity of the structure of the exchanger, or increasing the size thereof.

The solution according to the invention is therefore a heat exchanger comprising several plates arranged in parallel so as to define a first series of passages for channeling at least one first fluid, and a second series of passages for channeling at least one second fluid which is to be brought into a heat-exchanging relationship with at least said first fluid, a mixer device being arranged in said at least one passage of the first series and comprising:

- at least one first channel for the flow of a first phase of the first fluid in a flow direction, and
- at least one second channel for the flow of a second phase of the first fluid,
- at least one opening fluidically connecting the first channel (31) to the second channel, characterized in that said at least one opening comprises a first portion having a first cross-section, and a second portion having a second cross-section, the first cross-section being larger than the second cross-section.

Depending on the case, the exchanger of the invention may comprise one or more of the following technical features:

- the second portion (34*b*) opens into the second channel.
- the first portion (34*a*) and/or the second portion (34*b*) are cylindrical.
- said opening extends between the first channel and the second channel in a vertical direction.
- the first portion of at least one opening has a first cross-section which is variable in the vertical direction.
- the first cross-section of the first portion increases in the direction of the first channel.
- said first portion is frustoconical.
- the first portion comprises a peripheral wall forming an angle between 5° and 70° relative to the vertical direction.
- the ratio between the height of the first portion and the height of the opening measured in the vertical direction is between 0.1 and 0.7.
- the opening comprises a peripheral shoulder projecting radially relative to the vertical direction, said shoulder being arranged between the first portion and the second portion of the opening.
- the first channel comprises at least two openings each having a first portion in which the first cross-section varies from one of the two openings relative to the other.
- the first channel comprises at least two openings each having a second portion in which the second cross-section varies from one of the openings relative to the other.
- said at least two openings each comprise a first portion of cylindrical form, the diameter and/or height of which varies from one of the openings relative to the other.
- said at least two openings each comprise a first portion of frustoconical form, the angle and/or height of which varies from one of the openings relative to the other.
- the first fluid is a refrigerant fluid.
- the second fluid is a calorigenic fluid.

The present invention may apply to a heat exchanger which vaporizes at least one flow of liquid-gas mixture, particularly a flow of multi-constituent mixture, for example a mixture of hydrocarbons, through exchange of heat with at least one other fluid, for example natural gas.

The expression "natural gas" relates to any composition containing hydrocarbons, including at least methane. This comprises a "crude" composition (prior to any treatment or scrubbing) and also any composition which has been partially, substantially or completely treated for the reduction and/or removal of one or more compounds, including, but without being limited thereto, sulfur, carbon dioxide, water, mercury and certain heavy and aromatic hydrocarbons.

BRIEF DESCRIPTION OF THE DRAWINGS

The present invention will now be better understood by virtue of the following description, given solely by way of nonlimiting example and made with reference to the attached drawings among which.

DETAILED DESCRIPTION OF PREFERRED EMBODIMENTS

Figure 1:
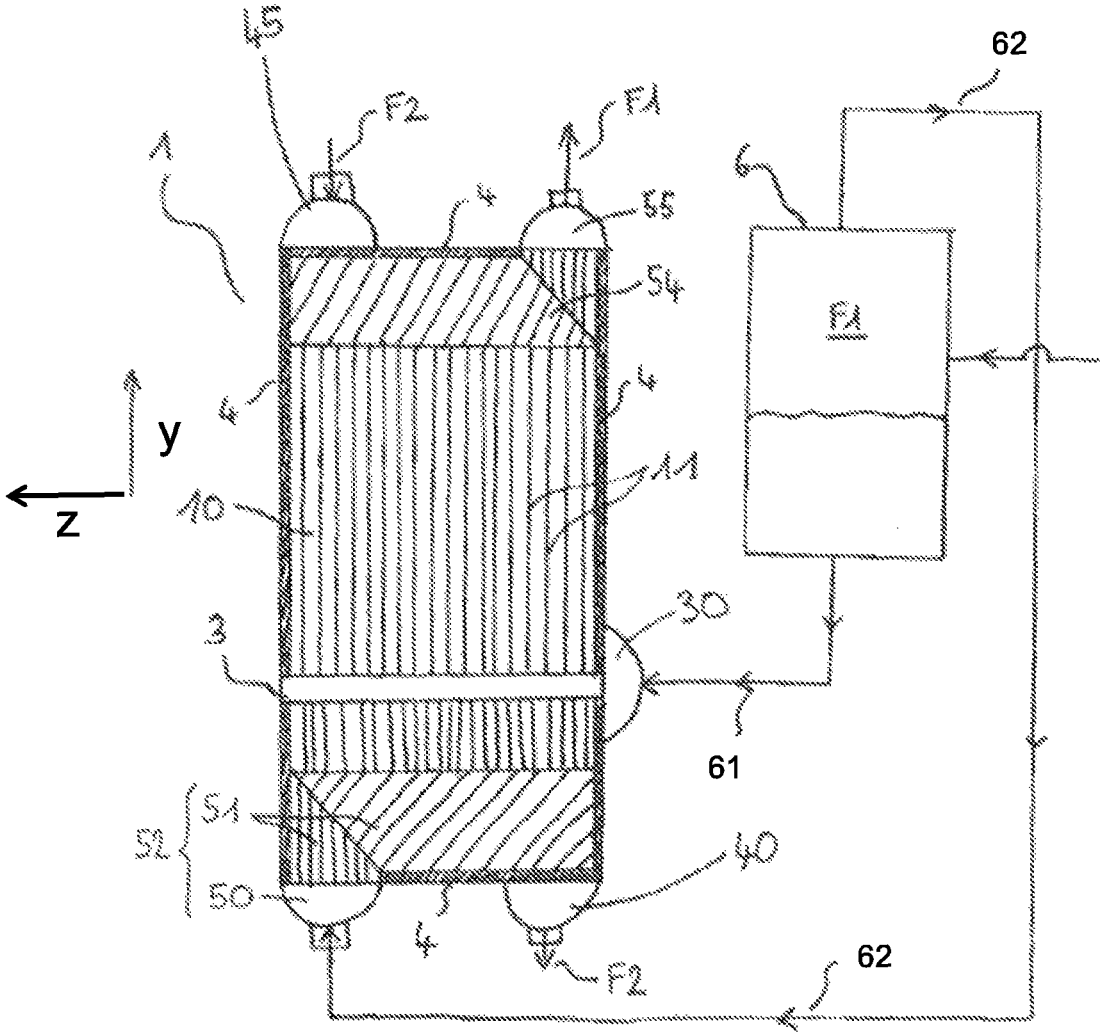
FIG. 1 is a schematic view in a sectional plane parallel to the plates of a heat exchanger, of part of the passage of an exchanger supplied with a two-phase liquid-gas mixture, according to one embodiment of the invention.

FIG. 1 illustrates a heat exchanger 1 comprising a stack of plates 2 (not shown) which extend in two dimensions parallel to a plane defined by direction is z and y. The plates 2 are arranged parallel to and above one another with a spacing, and thus form a plurality of passages for fluids in an indirect heat-exchange relationship via said plates.

For preference, each passage has a flat and parallelepipedal shape. The separation between two successive plates is small in comparison with the length and the width of each successive plate.

The exchanger 1 may comprise a number of plates in excess of 20, or even in excess of 100, between them defining a first series of passages 10 for channeling at least one first fluid F1, and a second series of passages 20 (not visible in FIG. 1) for channeling at least one second fluid F2, the flow of said fluids being overall in the direction y. The passages 10 of the first series may be arranged, all or some of them, to alternate with, or to be adjacent to, all or some of the passages 20 of the second series.

In a way known per se, the exchanger 1 comprises distribution and discharge means 40, 52, 45, 54, 55 configured to distribute the various fluids selectively into the passages 10, 20 and to discharge said fluids from said passages 10, 20.

The sealing of the passages 10, 20 along the edges of the plates 2 is generally afforded by lateral and longitudinal sealing strips 4 attached to the plates 2. The lateral sealing strips 4 do not completely block the passages 10, 20 but advantageously leave fluid inlet and outlet openings in the diagonally opposite corners of the passages.

The openings of the passages 10 of the first series are arranged in coincidence one above the other, whereas the openings of the passages 20 of the second series are arranged in the opposite corners. The openings placed one above the other are respectively united with one another in manifolds 40, 45, 50, 55 of semi-tubular shape via which the fluids are distributed and discharged.

In the depictions of FIG. 1, the semi-tubular manifolds 50, 45 are used to introduce the fluids into the exchanger 1, and the semi-tubular manifolds 40, 55 are used to discharge these fluids from the exchanger 1.

In this alternative form of embodiment, the manifold feeding one of the fluids and the manifold discharging the other fluid are situated at the one same end of the exchanger, the fluids F1, F2 thus flowing countercurrent-wise through the exchanger 1.

According to another variant embodiment, the first and second fluids may equally circulate co-currently, the means supplying one of the fluids and the means discharging the other fluid then being situated at opposite ends of the exchanger 1.

For preference, direction y is oriented vertically when the exchanger 1 is in operation. The first fluid F1 flows generally vertically and in the upward sense of that direction. Other directions and senses for the flow of the fluids F1, F2 are of course conceivable, without departing from the scope of the present invention.

It should be noted that, in the context of the invention, one or more first fluid(s) F1 and one or more second fluid(s) F2 of different natures may flow within the passages 10, 20 of the first and second series of a same exchanger.

The distribution and discharge means advantageously comprise distribution corrugations 51, 54, arranged between two successive plates 2 in the form of corrugated sheets, which extend from the inlet and outlet openings. The distribution corrugations 51, 54 ensure the uniform distribution and recovery of the fluids across the entire width of the passages 10, 20.

Furthermore, the passages 10, 20 advantageously comprise heat-exchange structures arranged between the plates 2. The purpose of these structures is to increase the heat-exchange surface area of the exchanger. Specifically, the heat-exchange structures are in contact with the fluids circulating in the passages and transfer thermal flux by conduction to the adjacent plates 2, to which they may be attached by brazing, thereby increasing the mechanical strength of the exchanger.

The heat-exchange structures also act as spacers between the plates 2, notably while the exchanger is being assembled by brazing, and in order to avoid any deformation of the plates during use of pressurized fluids. They also provide guidance for the flows of fluid in the passages of the exchanger.

For preference, these structures comprise heat-exchange corrugations 11 which advantageously extend across the width and the length of the passages 10, 20, parallel to the plates 2, in the prolongation of the distribution corrugations along the length of the passages 10, 20. The passages 10, 20 of the exchanger thus exhibit a main part of their length, constituting the heat-exchange part proper, which is covered with a heat-exchange structure, said main part being flanked by distribution parts covered with the distribution corrugations 51, 54.

FIG. 1 illustrates a passage 10 of the first series 1, configured to distribute a first fluid F1 in the form of a two-phase liquid-gas mixture. The first fluid F1 is separated in a separator device 6 into a liquid phase 61 and a gaseous phase 62 which are introduced separately into the exchanger 1 via a lateral manifold 30 and the manifold 50. The two phases 61, 62 are then mixed together by means of a mixer device 3 arranged in the passage 10. Advantageously, several passages 10, or even all of the passages 10 of the first series, comprise a mixing device 3.

Figure 2:
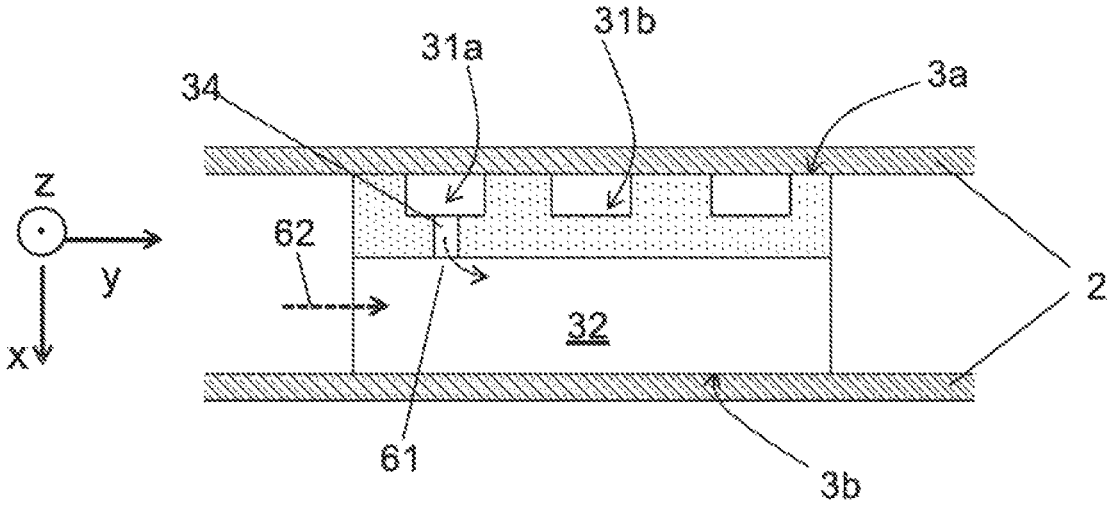
FIG. 2 is a schematic view in cross-section in a plane perpendicular to that of FIG. 1, illustrating the mixer device according from FIG. 1.

FIG. 2 is a diagrammatic cross-sectional view in a plane perpendicular to that of FIG. 1, of a mixer device 3 advantageously comprising a bar or rod housed in the passage 10.

Preferably, the mixer device 3 extends in the section of the passage 10 over almost all, or even the entire height of the passage 10 such that the mixer device is in contact with each plate 2*a*, 2*b* that forms the passage 10.

The mixer device 3 is advantageously fixed to the plates 2 by brazing.

The mixing device 3 is advantageously of parallelepipedal overall shape.

The mixer device 3 may exhibit, parallel to the lateral direction y, a first dimension between 20 and 200 mm and, parallel to the flow direction z, a second dimension between 100 and 1400 mm.

As shown on FIG. 2, a mixer device 3 according to one embodiment of the invention comprises several first channels 31*a*, 31*b*, . . . adapted for the flow of a first phase 61 of the fluid F1. Several openings 34 (only one is shown on FIG. 2) are arranged successively in the flow direction z of a first phase 61, which in the example illustrated is a first liquid phase 61, in a first channel 31*a*. These openings 34 are arranged so as to fluidically connect the first channel 31*a* to at least one second channel 32 intended for the flow of the other phase 62, in the example illustrated the gaseous phase 62. The first channels 31*a*, 31*b*, . . . and the second channels 32*a*, 32*b*, . . . extend parallel to the plates 2. The openings 34 of the various first channels 31*a*, 31*b*, . . . may be arranged in a staggered pattern as shown on FIG. 3, which promotes a more homogenous distribution of the first phase 61 in the second channel 32*a*, 32*b*, . . . .

Figure 3:
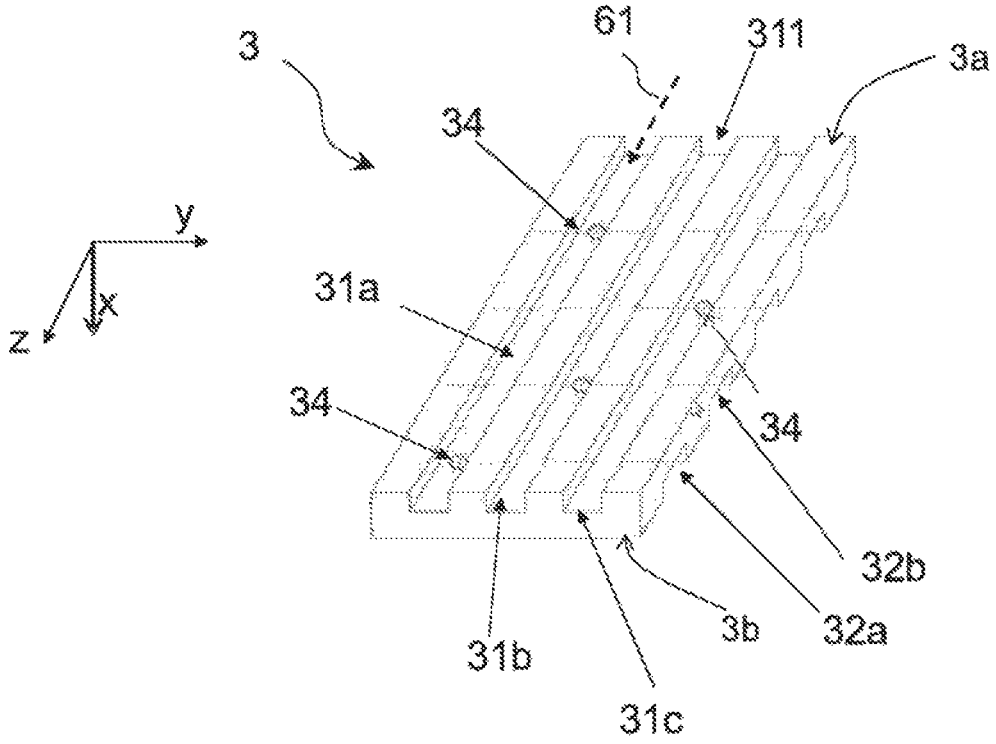
FIG. 3 depicts a schematic, three-dimensional view illustrating an embodiment of a mixer device according to an embodiment of the invention.

FIG. 3 shows a mixer device 3 according to one embodiment of the invention with several openings 34 fluidically connecting a series of first channels and a series of second channels.

According to the invention, at least one opening 34 comprises a first portion 34*a* opening into the first channel 31, said first portion 34*a* having a first cross-section, and a second portion 34*b* arranged between the first portion 34*a* and the second channel 32, said second portion 34*b* having a second cross-section, the first cross-section being larger than the second cross-section.

It is noted that the term "cross-section" means a surface area of the opening 34 measured perpendicularly to the opening 34, typically perpendicularly to the axis of symmetry A of the opening 34, wherein the opening 34 is advantageously cylindrically symmetrical. In the case of an opening 34 extending in a vertical direction x, the cross-section is measured in a cross-sectional plane extending perpendicularly to the direction x. In the examples given in FIGS. 2, 3, 4A and 4B, the cross-section of the opening 34 is therefore determined in a plane comprising directions y and z.

By arranging a first portion of larger cross-section at the inlet to at least one opening 34, it is possible to promote the flow of fluid injected into certain openings 34. Thus when the first phase 61 flows at different speeds along the first channel 31, it is possible to adapt accordingly the fluid flow into the openings 34 which are arranged successively along the direction z, so as to standardize their supply.

The result is a more homogenous distribution of the liquid-gas mixture in the width of the passage 10. This solution offers the advantages of being simple to implement, of not altering the size of the exchanger, and of not making its structure more complex.

Depending on the case, the first cross-section may be constant along the opening 34, i.e. the first portion 34*a* is cylindrical, or may be variable while remaining greater than the second cross-section of the second portion 34*b*, along the opening 34. In particular, the first cross-section of the first portion 34*a* may increase in the direction of the first channel 31.

The second cross-section of the second portion 34*b* may also be constant or variable along the opening 34.

Preferably, the first channel 31 comprises at least two openings each having a first portion 34*a*, in which the first cross-section varies from one of the two openings relative to the other.

The variation of the first passage cross-section of a first portion 34*a* relative to another first portion could for example result from a variation in diameter in the case of cylindrical first portions. It could also result from a variation in angle in the case of frustoconical first portions.

Advantageously, openings of larger first cross-section are arranged upstream in the first channel 31, where the speed of the first phase 61 is greater, and openings of smaller inlet cross-section are arranged downstream in the first channel 31.

In particular, the first channel 31 may comprise a first and a second opening 34 opening into the first channel 31 via a first inlet and a second inlet 341 respectively. The cross-section of at least one first channel 31 is varied at least at the level of the respective inlets 341.

According to a particular embodiment, at least two openings 34, arranged successively or not, in a same first channel 31 have different shapes. For example, an opening 34 with a first cylindrical portion, and an opening 34 with a first frustoconical portion, could be arranged along a same first channel. Preferably, an opening 34 arranged on the side of the inlet 311 of the first channel 31 has a shape promoting injection of the first phase 61 into the opening 34, so as to compensate for the effect of higher speed at the inlet of the first channel. The shape of the opening 34 may be modified in particular by modifying the shape of the first portion 34*a* of at least one opening 34 relative to another.

The arrangement of the openings 34 of variable shape along the flow direction z allows even finer adaptation of the fluid flow into the openings 34 arranged successively along the direction z.

In the context of the invention, the number of different shapes, their dimensions and distribution in a same first channel 31 or between several first channels 31*a*, 31*b*, . . . may vary as a function of the desired distribution of the liquid-gas mixture.

Depending on the case, the shape of an opening 34 may be varied relative to another opening 34 by modifying the cross-section of the opening at the inlet or outlet of the opening, along all or part of an opening, and/or by modifying the internal profile shape of one opening relative to another. Typically, the shape of the openings 34 is varied by adjusting the internal dimensions of said openings.

FIG. 3 shows an example of a mixer device 3 in the form of a bar, wherein openings 34 are drilled in the base of several first channels 31.

The mixer device 3 as a whole forms a parallelepiped, delimited in particular by a first surface 3*a* intended to be arranged facing a plate 2 of the exchanger, and a second surface 3*b* arranged facing another plate 2. The first and second surfaces 3*a*, 3*b* preferably extend generally parallel to the plates 2. The mixer device 3 is preferably arranged in the passage 10 such that the first and second surfaces 3*a*, 3*b* are in contact with the plates 2.

The first channels 31*a*, 31*b* advantageously take the form of recesses provided within the mixer device 3. They may also open at the level of surfaces 3*a* and/or 3*b*, the length of which is greater than the width measured in the lateral direction y, or the height measured in the vertical direction x perpendicularly to directions y and z.

The openings 34 are advantageously bores 34 made in the material of the device 3 and extending between the first channel 31 and the second channel 32, preferably in the vertical direction x. In operation, the first phase 61 then flows generally in the vertical direction x inside the opening 34.

Preferably, the openings 34 have a height measured in direction x of at least 0.5 mm.

Advantageously, the ratio between the height of the first portion 34*a* and the overall height of the opening 34 measured in the vertical direction is between 0.1 and 0.7. Such a range is preferably applied in the case of a frustoconical first portion. In the case of a cylindrical first portion, the height ratio is advantageously between 0.3 and 0.5.

The openings 34 are preferably cylindrically symmetrical around an axis of symmetry A.

Figure 4A:
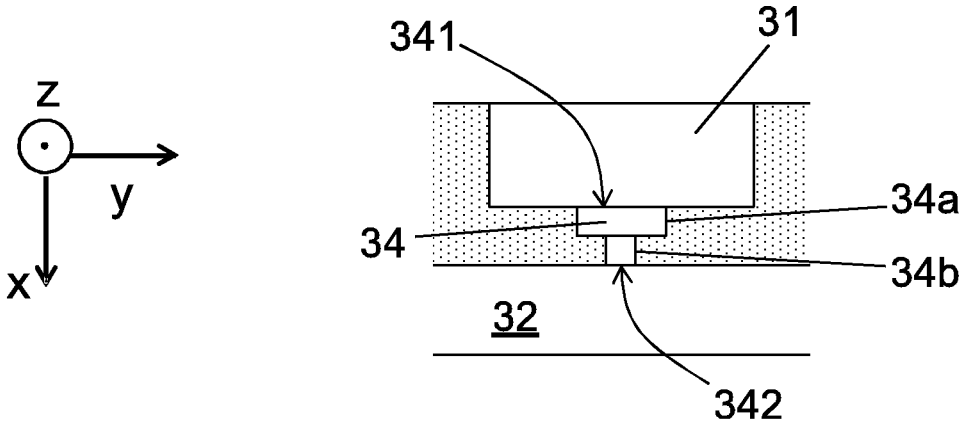
FIGS. 4A and 4B are schematic cross-sectional views illustrating variant embodiments of a mixer device according to the invention.
Figure 4B:
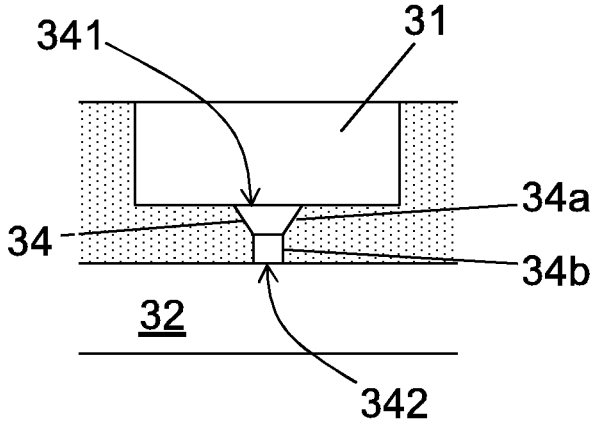

FIGS. 4A and 4B illustrate embodiments of openings 34 which may be used in the mixer device of FIG. 3. One or more openings produced according to one or more of these variants may be arranged in at least one first channel 31, wherein said first channel may also comprise conventional cylindrical openings 34 as illustrated on FIG. 2. Such openings 34 are preferably arranged on the side of the inlet 311.

According to a first embodiment illustrated on FIG. 4A, the opening 34 comprises a first portion 34*a* opening into the first channel 31 via an inlet 341, and a second portion 34*b* opening into the second channel 32 via an outlet 342 of the opening 34. The first and second portions 34*a*, 34*b* are cylindrical, the cross-section of the first portion 34*a* being greater than the cross-section of the second portion 34*b*. In other words, the first portion 34*a* has a first diameter which is greater than the second diameter of the second portion 34*b*.

The increase in the passage cross-section of the opening 34 on the side of the first channel promotes the flow of the first phase 61 towards the opening 34. One or more openings 34 of this type may be arranged in the first channel 31, wherein the cross-section of the first portion of the openings 34 may vary along a same first channel 31. In the depiction of FIG. 4A, the delimitation of the first and second portions 34*a*, 34*b* is achieved by means of a shoulder projecting radially relative to the vertical direction x.

According to a second embodiment illustrated in FIG. 4B, the first portion 34*a* is frustoconical and diverges towards the first channel 31.

This shape of opening 34 allows an increase in passage cross-section of the opening concerned on the side of the first channel 31, while creating a gentler curve when part of the first phase 61 flowing in the first channel enters the opening 34, which further facilitates its supply with a first phase 61. Such a frustoconical form may be obtained for example by drilling an opening 34 with a conical drill bit, the advance of which is adjusted as a function of the desired shape.

The angle $\alpha$ formed by the peripheral wall of the frustoconical first portion 34*a* with the vertical direction x may vary between the openings 34 arranged within a same first channel 31 along the flow direction z, and from one first channel 31 to another. Preferably, the peripheral wall of said first portion forms an angle $\alpha$ between 5° and 70° relative to the vertical direction x.

The shape of the second portion 34*b* arranged downstream of the first portion 34*a* may in some cases vary from one opening 34 to another, and in particular be frustoconical.

Preferably, openings 34 with first and second portions 34*a*, 34*b* as described above are obtained after a first step of machining several holes 34*b* within the mixer device 3, wherein one or more of these holes 34*b* is then remachined in a second step over a height corresponding to the height of the first portion 34*a*.

The device 3 may comprise several lateral channels 32 arranged successively within the device 3, and/or several first channels 31, the first and second channels 31, 32 being preferably parallel to each other.

It is emphasized that the channels 31 and 32 may have the same or different shapes and quantities. The distances between the successive first channels 31 and the distances between the successive second channels 32 may also vary.

Of course, the invention is not restricted to the particular examples described and illustrated in the present application. Other alternative forms or embodiments within the competence of those skilled in the art may also be considered without departing from the scope of the invention.

For example, the exchanger according to the invention is chiefly described for the case in which the passages 10, 20 extend in the lateral direction y, the first longitudinal channel 31 extending in the flow direction z, and the lateral channel 32 extending in the lateral direction y orthogonal to the direction z. The reverse is also conceivable, namely a first channel 31 extending in the lateral direction y, and a lateral channel 32 extending in the flow direction z. The directions y and z may also not be mutually orthogonal.

Also, at least one first longitudinal channel 31 may comprise one or more openings 34 with a first portion 34*a* which is itself formed from several sub-portions of cylindrical and/or frustoconical form.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

The invention claimed is:

1. A heat exchanger comprising several plates arranged in parallel thereby defining a first series of passages for channeling at least one first fluid and a second series of passages for channeling at least one second fluid, the at least one second fluid being in a heat-exchange relationship with at least said one first fluid, wherein a mixer device is arranged in said at least one passage of the first series and comprising:

at least one first channel for the flow of a first phase of the first fluid in a flow direction, at least one second channel for the flow of a second phase of the first fluid, and at least one opening fluidically connecting the first channel to the second channel, wherein the at least one opening comprises a first portion opening into the first channel, said first portion having a first cross-section, and a second portion arranged between the first portion and the second channel, said second portion having a second cross-section, the first cross-section being larger than the second cross-section, wherein the opening extends between the first channel and the second channel in a vertical direction, wherein the first portion is frustoconical.

2. The heat exchanger as claimed in claim 1, wherein the first portion comprises a peripheral wall forming an angle between 5° and 70° relative to the vertical direction.

3. A heat exchanger comprising several plates arranged in parallel thereby defining a first series of passages for channeling at least one first fluid and a second series of passages for channeling at least one second fluid, the at least one second fluid being in a heat-exchange relationship with at least said one first fluid, wherein a mixer device is arranged in said at least one passage of the first series and comprising:

at least one first channel for the flow of a first phase of the first fluid in a flow direction, at least one second channel for the flow of a second phase of the first fluid, and at least one opening fluidically connecting the first channel to the second channel, Wherein the at least one opening comprises a first portion opening into the first channel, said first portion having a first cross-section, and a second portion arranged between the first portion and the second channel, said second portion having a second cross-section, the first cross-section being larger than the second cross-section, wherein the first channel comprises at least two openings each having a first portion in which the first cross-section varies from one of the two openings relative to the other, wherein the at least two openings each comprise a first portion of frustoconical form, the angle and/or height of which varies from one of the openings relative to the other.

* * * * *